US009914202B2

(12) United States Patent
Portaro

(10) Patent No.: US 9,914,202 B2
(45) Date of Patent: Mar. 13, 2018

(54) LIGHTED TOOL SHAFT ATTACHMENT

(71) Applicant: Keith Portaro, Plainview, NY (US)

(72) Inventor: Keith Portaro, Plainview, NY (US)

( * ) Notice: Subject to any disclaimer, the term of this patent is extended or adjusted under 35 U.S.C. 154(b) by 0 days.

(21) Appl. No.: 15/217,586

(22) Filed: Jul. 22, 2016

(65) Prior Publication Data

US 2018/0021930 A1 Jan. 25, 2018

(51) Int. Cl.

| | |
|---|---|
| ***B25B 23/18*** | (2006.01) |
| ***F21V 33/00*** | (2006.01) |
| ***B25B 15/00*** | (2006.01) |
| ***F21V 21/08*** | (2006.01) |
| ***F21V 23/04*** | (2006.01) |
| ***F21V 23/02*** | (2006.01) |

(52) U.S. Cl.

CPC ..... *B25B 23/18* (2013.01); *B25B 15/007* (2013.01); *F21V 21/08* (2013.01); *F21V 23/02* (2013.01); *F21V 23/04* (2013.01); *F21V 33/0084* (2013.01)

(58) Field of Classification Search

CPC ..... F21V 33/008; F21V 33/0084; B25B 23/18
See application file for complete search history.

(56) References Cited

U.S. PATENT DOCUMENTS 3,919,541 A * 11/1975 Chao ..... B25B 23/18 362/120
4,480,295 A * 10/1984 Shuster ..... B25B 23/18 200/60
5,211,468 A 5/1993 Jeng
5,785,408 A 7/1998 Tseng
5,845,986 A * 12/1998 Breen ..... B25B 23/18 362/119
6,022,121 A * 2/2000 Lin ..... B25B 23/18 362/119
D425,388 S 5/2000 Lin
6,116,747 A 9/2000 Grawemeyer et al.
7,066,615 B2 6/2006 Diggle, III et al.
2002/0105797 A1* 8/2002 Navid ..... B25B 23/18 362/120
2003/0058637 A1* 3/2003 Hsien ..... B25B 23/18 362/119
2008/0278931 A1 11/2008 Wu et al.
2009/0256319 A1* 10/2009 Seymour ..... B23B 31/1071 279/75
2015/0049467 A1* 2/2015 Thompson ..... B25B 23/18 362/120

* cited by examiner

*Primary Examiner* — Mariceli Santiago

(57) ABSTRACT

A lighted tool shaft attachment for lighting a work space at a working end of the tool includes a sleeve that comprises an inner wall and an outer wall, which define an interior space. The inner wall also defines a channel that is positioned longitudinally through the sleeve and configured for insertion a shaft of a tool. The sleeve is reversibly couplable to the shaft. A power module is coupled to the sleeve and positioned in the interior space. A plurality of lights is coupled to a first end of the sleeve. A switch, which is coupled to the outer, is operationally coupled to the power module and the plurality of lights. The switch is configured for activation by a user to couple the power module to the lights. The lights are configured to illuminate a work space at a working end of the shaft of the tool.

17 Claims, 4 Drawing Sheets

LIGHTED TOOL SHAFT ATTACHMENT

CROSS-REFERENCE TO RELATED APPLICATIONS

Not Applicable

STATEMENT REGARDING FEDERALLY SPONSORED RESEARCH OR DEVELOPMENT

Not Applicable

THE NAMES OF THE PARTIES TO A JOINT RESEARCH AGREEMENT

Not Applicable

INCORPORATION-BY-REFERENCE OF MATERIAL SUBMITTED ON A COMPACT DISC OR AS A TEXT FILE VIE THE OFFICE ELECTRONIC FILING SYSTEM

Not Applicable

STATEMENT REGARDING PRIOR DISCLOSURES BY THE INVENTOR OR JOINT INVENTOR

Not Applicable

BACKGROUND OF THE INVENTION

(1) Field of the Invention

(2) Description of Related Art Including Information Disclosed Under 37 CFR 1.97 and 1.98

The disclosure and prior art relates to tool attachments and more particularly pertains to a new tool attachment for lighting a work space at a working end of the tool.

BRIEF SUMMARY OF THE INVENTION

An embodiment of the disclosure meets the needs presented above by generally comprising a sleeve that comprises an inner wall and an outer wall, which define an interior space. The inner wall also defines a channel that is positioned longitudinally through the sleeve and configured for insertion a shaft of a tool. The sleeve is reversibly couplable to the shaft. A power module is coupled to the sleeve and positioned in the interior space. A plurality of lights is coupled to a first end of the sleeve. A switch, which is coupled to the outer, is operationally coupled to the power module and the plurality of lights. The switch is configured for activation by a user to couple the power module to the lights. The lights are configured to illuminate a work space at a working end of the shaft of the tool.

There has thus been outlined, rather broadly, the more important features of the disclosure in order that the detailed description thereof that follows may be better understood, and in order that the present contribution to the art may be better appreciated. There are additional features of the disclosure that will be described hereinafter and which will form the subject matter of the claims appended hereto.

The objects of the disclosure, along with the various features of novelty which characterize the disclosure, are pointed out with particularity in the claims annexed to and forming a part of this disclosure.

BRIEF DESCRIPTION OF SEVERAL VIEWS OF THE DRAWING(S)

The disclosure will be better understood and objects other than those set forth above will become apparent when consideration is given to the following detailed description thereof. Such description makes reference to the annexed drawings wherein.

DETAILED DESCRIPTION OF THE INVENTION

Figure 1:
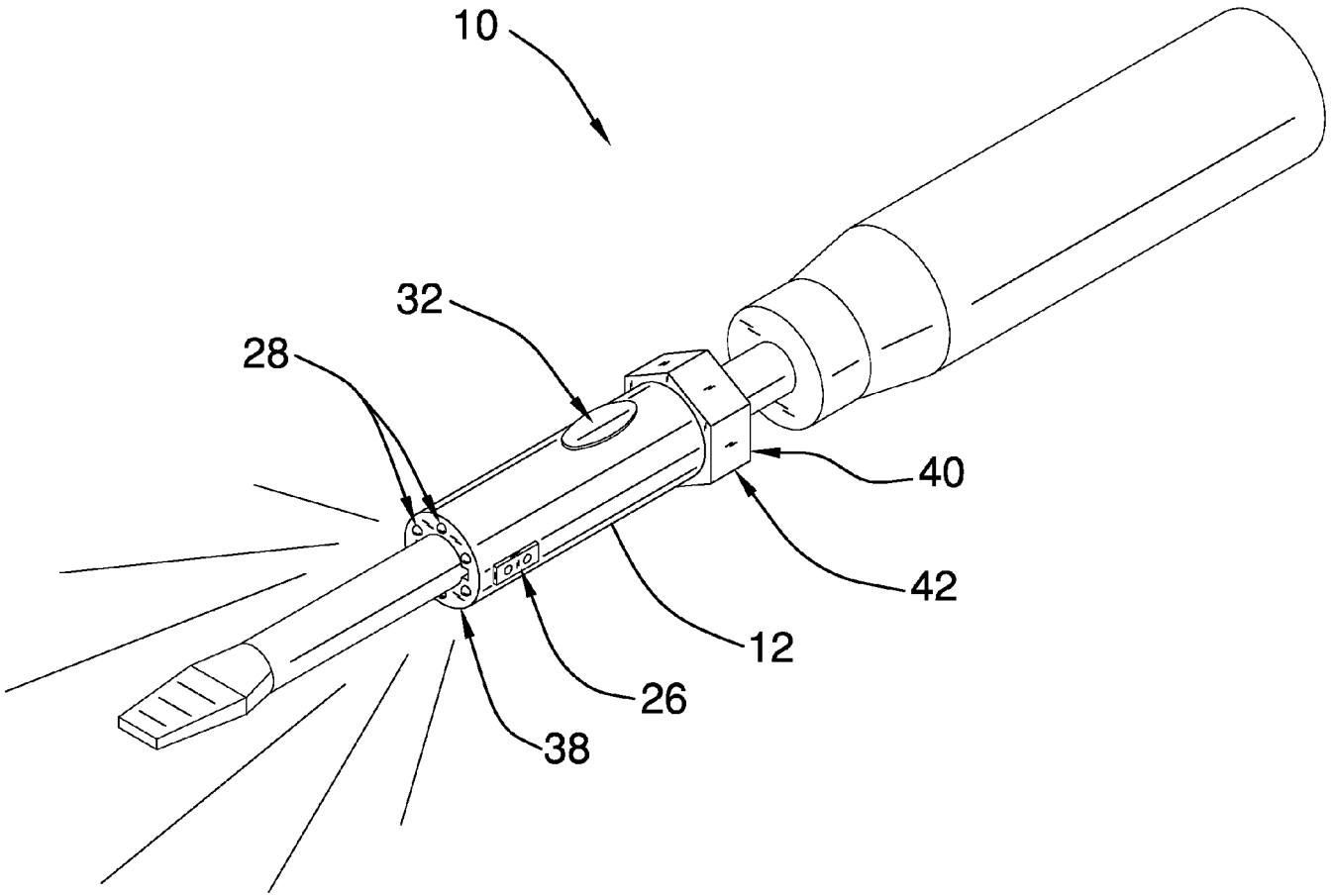
FIG. 1 is an isometric perspective view of a lighted tool shaft attachment according to an embodiment of the disclosure.
Figure 2:
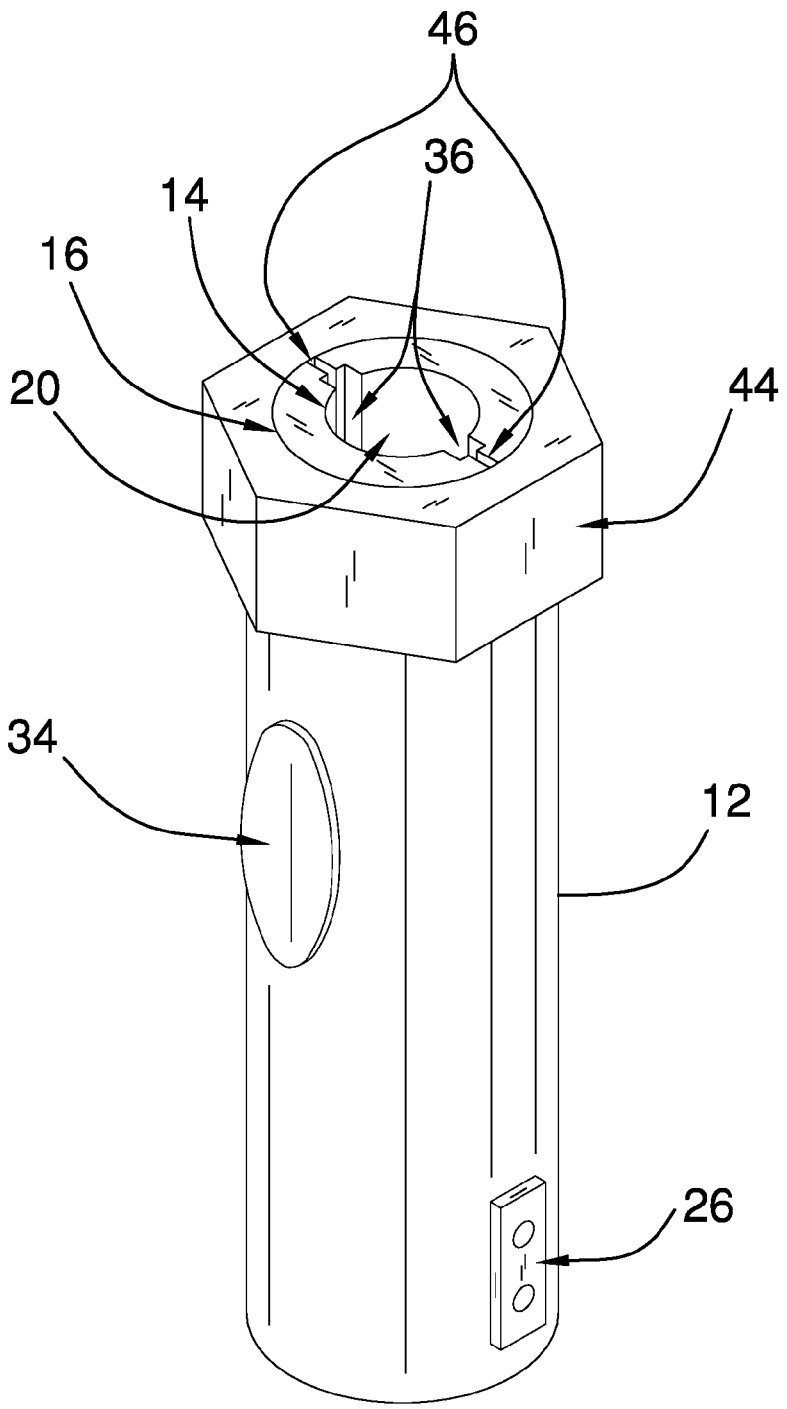
FIG. 2 is an isometric perspective view of an embodiment of the disclosure.
Figure 4:
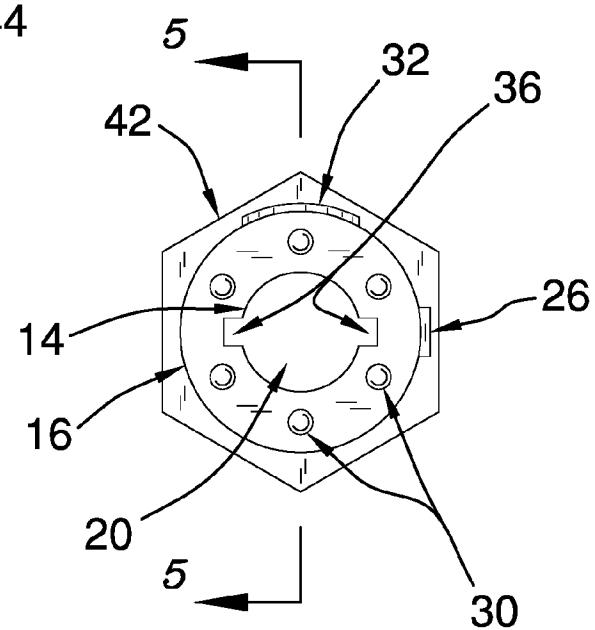
FIG. 4 is an end view of an embodiment of the disclosure.
Figure 3:
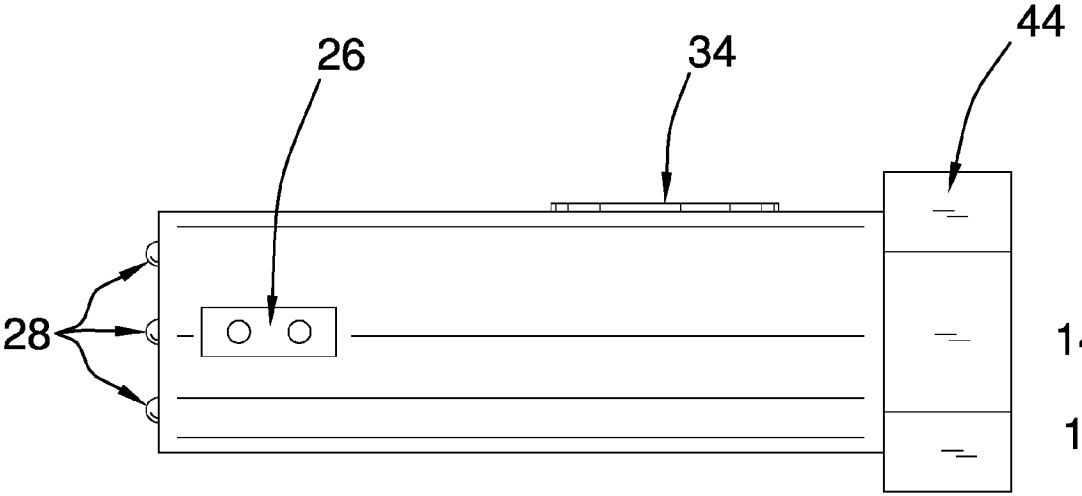
FIG. 3 is a side view of an embodiment of the disclosure.
Figure 5:
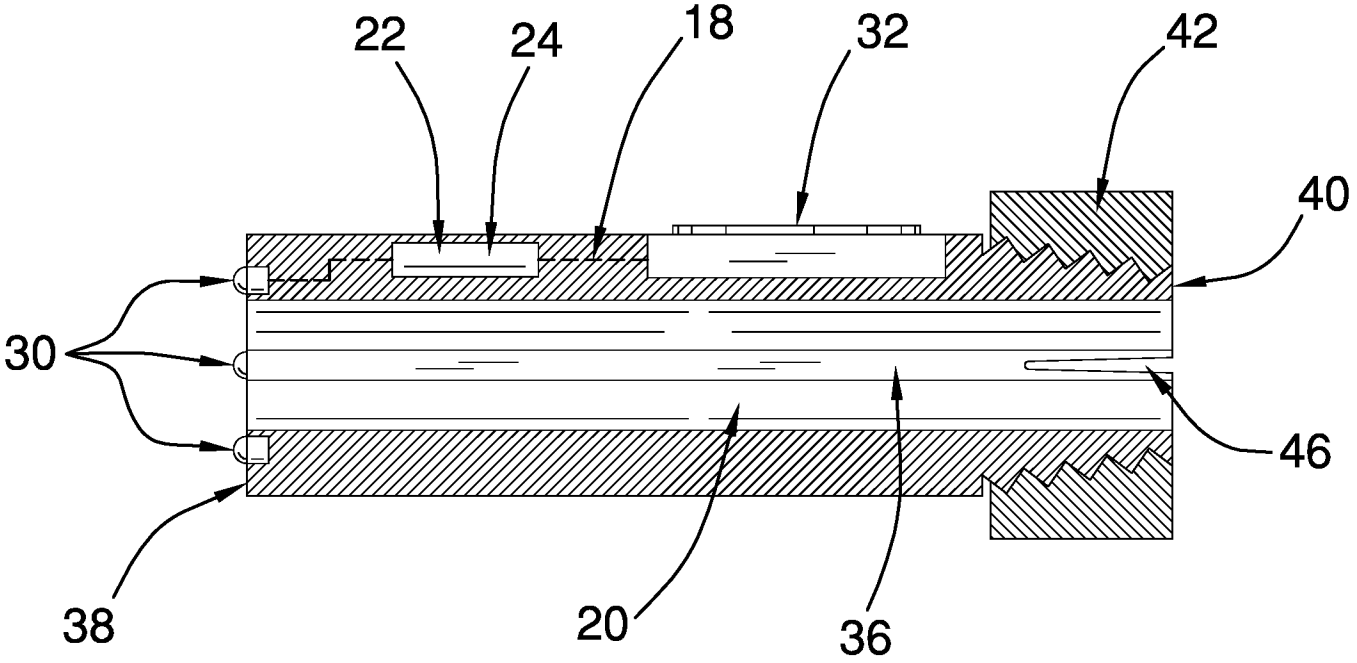
FIG. 5 is a cross-sectional view of an embodiment of the disclosure.

With reference now to the drawings, and in particular to FIGS. 1 through 5 thereof, a new tool attachment embodying the principles and concepts of an embodiment of the disclosure and generally designated by the reference numeral 10 will be described.

As best illustrated in FIGS. 1 through 5, the lighted tool shaft attachment 10 generally comprises a sleeve 12, which comprises an inner wall 14 and an outer wall 16 that define an interior space 18. The inner wall 14 also defines a channel 20 that is positioned longitudinally through the sleeve 12. The sleeve 12 is reversibly couplable to a shaft of a tool. The channel 20 is substantially complementary to the shaft of the tool. In one embodiment, the sleeve 12 comprises metal. In another embodiment, the sleeve 12 comprises plastic.

A power module 22 is coupled to the sleeve 12 and positioned in the interior space 18. The power module 22 comprises at least one battery 24. In one embodiment, the battery 24 is rechargeable. A port 26 is coupled to the outer wall 16. The port 26 is operationally coupled to the battery 24. The port 26 is configured to couple to a power source. The port 26 is positioned on the sleeve 12 such that the port 26 is configured to couple to a power source to recharge the battery 24.

A plurality of lights 28 is coupled to a first end 38 of the sleeve 12. The lights 28 comprise light emitting diodes 30. In one embodiment, the plurality of lights 28 comprises from two to ten the lights 28. In another embodiment, the plurality of lights 28 comprises from four to eight the lights 28. In yet another embodiment, the plurality of lights 28 comprises six the lights 28.

A switch 32 is coupled to the outer wall 16 of the sleeve 12. The switch 32 is operationally coupled to the power module 22 and the plurality of lights 28. In one embodiment, the switch 32 comprises a button 34. The button 34 is depressible a first time to electrically couple the lights 28 to the power module 22 and a second time to decouple the lights 28 from the power module 22. The button 34 is ovally shaped.

A pair of slots 36 is positioned in the inner wall 14 and extends from the first end 38 to a second end 40 of the sleeve 12. The slots 36 are positioned in the inner wall 14 such that the slots 36 are configured for insertion of a head of a flathead screwdriver.

A compression collar 42 is threadably couplable to the second end 40 of the sleeve 12. In one embodiment, the compression collar 42 comprises a nut 44 that is hexagonally shaped when viewed axially.

A pair of slits 46 is positioned in the sleeve 12 adjacent to the second end 40. The slits 46 extend toward the first end 38. The slits 46 are positioned to at least partially close as the compression collar 42 is tightened on the second end 40 of the sleeve 12, such that the sleeve 12 is coupled to the shaft of the tool. In one embodiment, the slits 46 are positioned singly in the slots 36.

In use, the channel 20 is configured for insertion of a shaft of a tool. The second end 40 of the shell is positioned to couple to the compression collar 42 such that the shell is coupled to the shaft. The switch 32 is positioned on the shell such that the switch 32 is configured for activation by a user. The switch 32 is positioned to electrically couple the power module 22 to the lights 28. The lights 28 are positioned on the shell such that the lights 28 are configured to illuminate a work space at a working end of the shaft of the tool.

With respect to the above description then, it is to be realized that the optimum dimensional relationships for the parts of an embodiment enabled by the disclosure, to include variations in size, materials, shape, form, function and manner of operation, assembly and use, are deemed readily apparent and obvious to one skilled in the art, and all equivalent relationships to those illustrated in the drawings and described in the specification are intended to be encompassed by an embodiment of the disclosure.

Therefore, the foregoing is considered as illustrative only of the principles of the disclosure. Further, since numerous modifications and changes will readily occur to those skilled in the art, it is not desired to limit the disclosure to the exact construction and operation shown and described, and accordingly, all suitable modifications and equivalents may be resorted to, falling within the scope of the disclosure. In this patent document, the word "comprising" is used in its non-limiting sense to mean that items following the word are included, but items not specifically mentioned are not excluded. A reference to an element by the indefinite article "a" does not exclude the possibility that more than one of the element is present, unless the context clearly requires that there be only one of the elements.

I claim:

1. A lighted tool shaft attachment comprising:

a sleeve comprising an inner wall and an outer wall defining an interior space, said inner wall defining a channel positioned longitudinally through said sleeve, said sleeve being reversibly couplable to a shaft of a tool;

a power module coupled to said sleeve and positioned in said interior space;

a plurality of lights coupled to a first end of said sleeve;

a switch coupled to said outer wall of said sleeve, said switch being operationally coupled to said power module and said plurality of lights;

wherein said channel is configured for insertion of a shaft of a tool such that said sleeve is coupled to the shaft, wherein said switch is positioned on said sleeve such that said switch is configured for activation by a user, wherein said switch is positioned to couple said power module to said lights, wherein said lights are positioned on said sleeve such that said lights are configured to illuminate a work space at a working end of the shaft of the tool;

a compression collar threadably couplable to a second end of said sleeve;

a pair of slits positioned in said sleeve adjacent to said second end, said slits extending toward said first end; and wherein said slits are positioned to at least partially close as said compression collar is tightened on said second end of said sleeve, wherein said sleeve is coupled to the shaft of the tool.

2. The attachment of claim 1, further including said channel being substantially complementary to the shaft of the tool.

3. The attachment of claim 1, further including said sleeve comprising metal.

4. The attachment of claim 1, further including said sleeve comprising plastic.

5. The attachment of claim 1, further including said power module comprising at least one battery.

6. The attachment of claim 5, further including said battery being rechargeable.

7. The attachment of claim 1, further including said lights comprising light emitting diodes.

8. The attachment of claim 1, further including said plurality of lights comprising from two to ten said lights.

9. The attachment of claim 8, further including said plurality of lights comprising from four to eight said lights.

10. The attachment of claim 9, further including said plurality of lights comprising six said lights.

11. The attachment of claim 1, further including said switch comprising a button, said button being depressible, wherein said button is depressible a first time to electrically couple said lights to said power module and wherein said button is depressible a second time to decouple said lights from said power module.

12. The attachment of claim 11, further including said button being ovally shaped.

13. The attachment of claim 1, further including a pair of slots positioned in said inner wall and extending from a first end of said sleeve to a second end of said sleeve, wherein said slots are positioned in said inner wall such that said slots are configured for insertion of a head of a flathead screwdriver.

14. The attachment of claim 1, further comprising:

a pair of slots positioned in said inner wall and extending from said first end to said second end;

said slits being positioned singly in said slots; and said compression collar comprising a nut, said nut being hexagonally shaped when viewed axially.

15. The attachment of claim 1, further comprising a port coupled to said outer wall, said port being operationally coupled to said battery, said port being configured for coupling to a power source, wherein said port is positioned on said sleeve such that said port is configured for coupling to a power source to recharge said battery.

16. A lighted tool shaft attachment comprising:

a sleeve comprising an inner wall and an outer wall defining an interior space, said inner wall defining a channel positioned longitudinally through said sleeve, said sleeve being reversibly couplable to a shaft of a tool, said channel being substantially complementary to the shaft of the tool, said sleeve comprising metal;

a power module coupled to said sleeve and positioned in said interior space, said power module comprising at least one battery, said battery being rechargeable;

a plurality of lights coupled to a first end of said sleeve, said lights comprising light emitting diodes, said plurality of lights comprising from two to ten said lights;

a switch coupled to said outer wall of said sleeve, said switch being operationally coupled to said power module and said plurality of lights, said switch comprising a button, said button being depressible, wherein said button is depressible a first time to electrically couple said lights to said power module and wherein said button is depressible a second time to decouple said lights from said power module, said button being ovally shaped;

a pair of slots positioned in said inner wall and extending from a first end of said sleeve to a second end of said sleeve, wherein said slots are positioned in said inner wall such that said slots are configured for insertion of a head of a flathead screwdriver;

a compression collar threadably couplable to a second end of said sleeve, said compression collar comprising a nut, said nut being hexagonally shaped when viewed axially, a pair of slits positioned in said sleeve adjacent to said second end, said slits extending toward said first end, wherein said slits are positioned to at least partially close as said compression collar is tightened on said second end of said sleeve, wherein said sleeve is coupled to the shaft of the tool, said slits being positioned singly in said slots;

a port coupled to said outer wall, said port being operationally coupled to said battery, said port being configured for coupling to a power source, wherein said port is positioned on said sleeve such that said port is configured for coupling to a power source to recharge said battery; and wherein said channel is configured for insertion of a shaft of a tool, wherein said second end of said sleeve is positioned for coupling to said compression collar such that said sleeve is coupled to the shaft, wherein said switch is positioned on said sleeve such that said switch is configured for activation by a user, wherein said switch is positioned to electrically couple said power module to said lights, wherein said lights are positioned on said sleeve such that said lights are configured to illuminate a work space at a working end of the shaft of the tool.

17. The attachment of claim 16, further including said sleeve comprising plastic.

* * * * *